US006526627B2

(12) United States Patent
Chiang

(10) Patent No.: US 6,526,627 B2
(45) Date of Patent: Mar. 4, 2003

(54) HINGE AUTO-RETURN DEVICE FOR A GLASS DOOR

(76) Inventor: Fanny Chiang, 11 Fl.-4, No. 16, Chungming S. Rd., West Dist., Taichung (TW)

( * ) Notice: Subject to any disclaimer, the term of this patent is extended or adjusted under 35 U.S.C. 154(b) by 0 days.

(21) Appl. No.: 09/957,860

(22) Filed: Sep. 21, 2001

(65) Prior Publication Data

US 2002/0066161 A1 Jun. 6, 2002

Related U.S. Application Data

(63) Continuation-in-part of application No. 09/730,055, filed on Dec. 5, 2000.

(51) Int. Cl.[7] ..... E05F 1/14; E05D 7/08
(52) U.S. Cl. ..... 16/284; 16/280; 16/281
(58) Field of Search ..... 16/284, 280, 281, 16/282, 283, 286, 296, 252, 335, 68

(56) References Cited

U.S. PATENT DOCUMENTS 1,122,322 A * 12/1914 Smith ..... 16/284
RE28,786 E * 4/1976 MacDonald ..... 16/141
5,077,864 A * 1/1992 Kawasaki ..... 16/281
5,079,798 A * 1/1992 Burke et al. ..... 16/281
5,297,313 A * 3/1994 Brin ..... 16/281
5,500,983 A * 3/1996 Lautenschläger ..... 16/297
5,867,869 A * 2/1999 Garrett et al. ..... 16/252
5,867,871 A * 2/1999 Tasman ..... 16/335
6,070,294 A * 6/2000 Perkins et al. ..... 16/286
6,161,255 A * 12/2000 Garrett ..... 16/284

* cited by examiner

*Primary Examiner*—Lynne H. Browne
*Assistant Examiner*—Doug Hutton
(74) *Attorney, Agent, or Firm*—Dellett and Walters

(57) ABSTRACT

An hinge auto-return device for a glass door includes a body containing a longitudinal pivot hole to rotatably receive a pivot pin in the body and a lateral guide hole to movably receive a positioning block in the body. The lateral guide hole extends perpendicular to communicate with the pivot hole. At lest one blind hole is longitudinally defined in the positioning block to mount at least one resilient member in the positioning block. The positioning block has a contact face forced by the resilience of the resilient member to press against a flat segment of the pivot pin when a hinge assembled with the auto-return device is attached to a glass door and hinges the glass door on a doorframe. The positioning block is able to slide smoothly in the guide hole in the body of the auto-return device so that the auto-return device performs reliably and durably.

4 Claims, 12 Drawing Sheets

HINGE AUTO-RETURN DEVICE FOR A GLASS DOOR

CROSS-REFERENCE TO RELATED APPLICATION

The present invention is a continuation-in-part (CIP) application of the U.S. Ser. No. 09/730,055, filed on Dec. 5, 2000, now pending, by the same applicant of this application.

BACKGROUND OF THE INVENTION

1. Field of the Invention

The present invention relates to a hinge auto-return device, and more particularly to a hinge auto-return device used for a glass door that is extremely reliable and durable.

2. Description of Related Art

There are two types of hinges commonly used for glass doors. A first type of hinge is attached to the vertical casement and at one side of a glass door. A second type of hinge is attached to an upper or lower doorframe and to the corresponding end of the glass door.

With reference to FIG. 8, the first type of hinge comprises a mounting plate (41) attached to a vertical casement (52), two door mounting plates (51) attached to opposite surfaces of one edge of a glass door (50), and an auto-return device (60). A first edge of the auto-return device (60) is securely attached to the mounting plate (41), and the door mounting plates (51) are pivotally connected at a second edge of the auto-return device (60).

With reference to FIGS. 9–11, the auto-return device (60) comprises a body (61), a pivot hole (62), two parallel guide holes (63), a pivot pin (64), two plugs (66) and two springs (69). The pivot hole (62), previously called "a spindle hole," is longitudinally defined in the body (61). The two parallel guide holes (63) are laterally defined in the body (61) and communicate with the pivot hole (62). The pivot pin (64), previously called "a spindle," has two keyed ends (not numbered) that fit into corresponding keyholes (not shown) in the door mounting plates (51) and is rotatably received in the pivot hole (62) in the body (61). A plug (66), previously called "a T-shaped member," is movably mounted in each guide hole (63). A spring (69) is mounted in each guide hole (63) between the corresponding plug (66) and the door mounting plate (51). The pivot pin (64) is formed with a cylindrical surface and a longitudinal flat segment (65) corresponding to the guide holes (63). Each of the two plugs (66) has an enlarged head (67), previously called a "bottom," and a neck (68), previously called "a rod," extending axially from the enlarged head (67). The enlarged head (67) of the plug (66) presses against the flat segment (65) of the pivot pin (64) and the neck (68) of the plug (66) is inserted into a corresponding one of the two springs (69). When the glass door (50) is opened, the pivot pin (64) turns along with the door mounting plates (51) and the glass door (50), and the head (67) of each of the plugs (66), pressed by the cylindrical surface of the pivot pin (64), moves toward the corresponding spring (69). The spring (69) is compressed by the plug (66). When the glass door (50) is released, the plug (66) is forced by the resilience of the springs (69) to move towards the pivot pin (64) until the head (67) of the plug (66) abuts the flat segment (65) of the pivot pin (64).

With reference to FIG. 12, a second type of hinge comprises a mounting plate (41) attached to horizontal segment of a doorframe (52), two door mounting plates (51) attached to opposite surfaces of an upper end of a glass door (50) and an auto-return device (not numbered). The auto-return device includes a pivot pin (70) formed with two flat longitudinal segments (71) on opposite sides of the pivot pin (70). The pivot pin (70) includes an upper end securely connected to the mounting plate (41) and a lower end extending through a pivot hole (not numbered) defined perpendicular in a center of a body (72). Each sides of the body (72) has two guide holes (73) defined horizontally in the body (72) and communicating with the pivot hole. Each of the guide holes (73) has an inner thread (74) formed at an open end of the guide hole (73) in the body (72). A plug (75) is movably received in the guide hole (73) and abuts one of the flat segments (71) of the pivot pin (70). A spring (76) is received in the guide hole (73) between the plug (75) and a threaded plug (77) screwed into the inner thread (74) at the open end of the guide hole (73).

The conventional hinge auto-return device for glass doors has the following disadvantages.

1. Because the only the outer surface of the enlarged head of the plug abuts the inner surface of the guide hole, the axial alignment of the plugs in the guide holes is unstable. Consequently, the plugs will pivot slightly in the guide holes when the door opens and will reduced the restoration force applied to the pivot pin.

2. The plugs will jam in the guide hole when it is moving along the guide hole when the glass door is opening or closing.

3. As the plug is often excessively abraded during normal operations, the useful life of the auto-return device of a hinge be reduced.

The present invention has arisen to mitigate and/or obviate the disadvantages of the conventional auto-return device of a hinge for a glass door.

SUMMARY OF THE INVENTION

The main objective of the present invention is to provide a more reliable hinge auto-return device for a glass door, which will extend the life of the auto-return device.

To achieve the objective, the auto-return device in accordance with the present invention comprises a body containing a longitudinal pivot hole to rotatably receive a pivot pin in the body and a lateral guide hole for movably a receiving a positioning block in the body. The lateral guide hole perpendicularly communicates with the pivot hole. At least one blind hole is longitudinally defined in the positioning block to receive at least one resilient member in the positioning block. The positioning block has a contact face forced by resilience of the resilient member to press against a flat segment of the pivot pin when a hinge with the auto-return device is attached to a glass door. The positioning block is able to slide smoothly in the guide hole in the body of the auto-return device without binding or jamming or experiencing undue wear.

Further benefits and advantages of the present invention will become apparent after a careful reading of the detailed description with appropriate reference to the accompanying drawings.

DETAILED DESCRIPTION OF THE INVENTION

Figure 1:
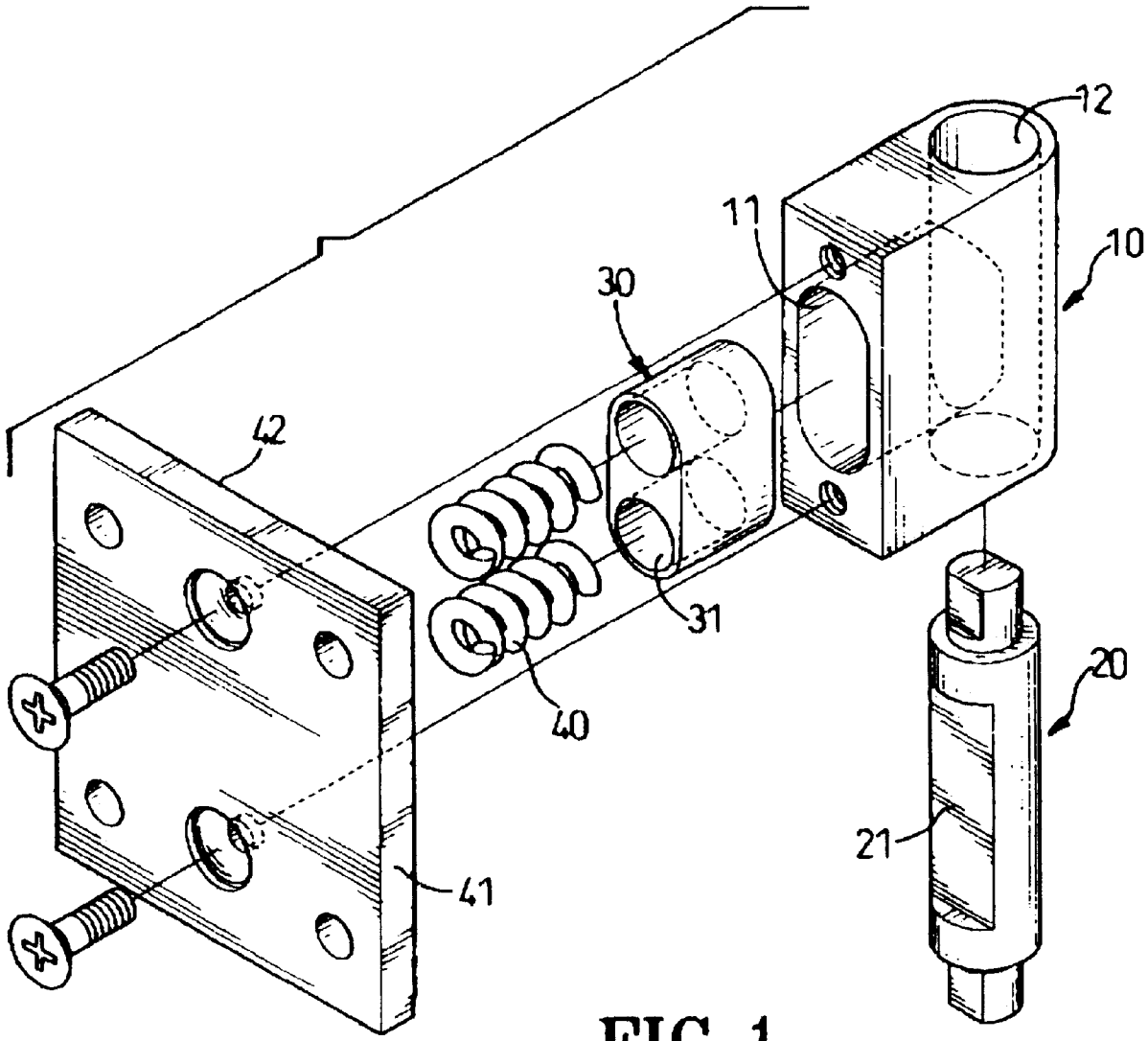
FIG. 1 is an exploded perspective view of a hinge auto-return device for a glass door in accordance with the present invention.
Figure 2:
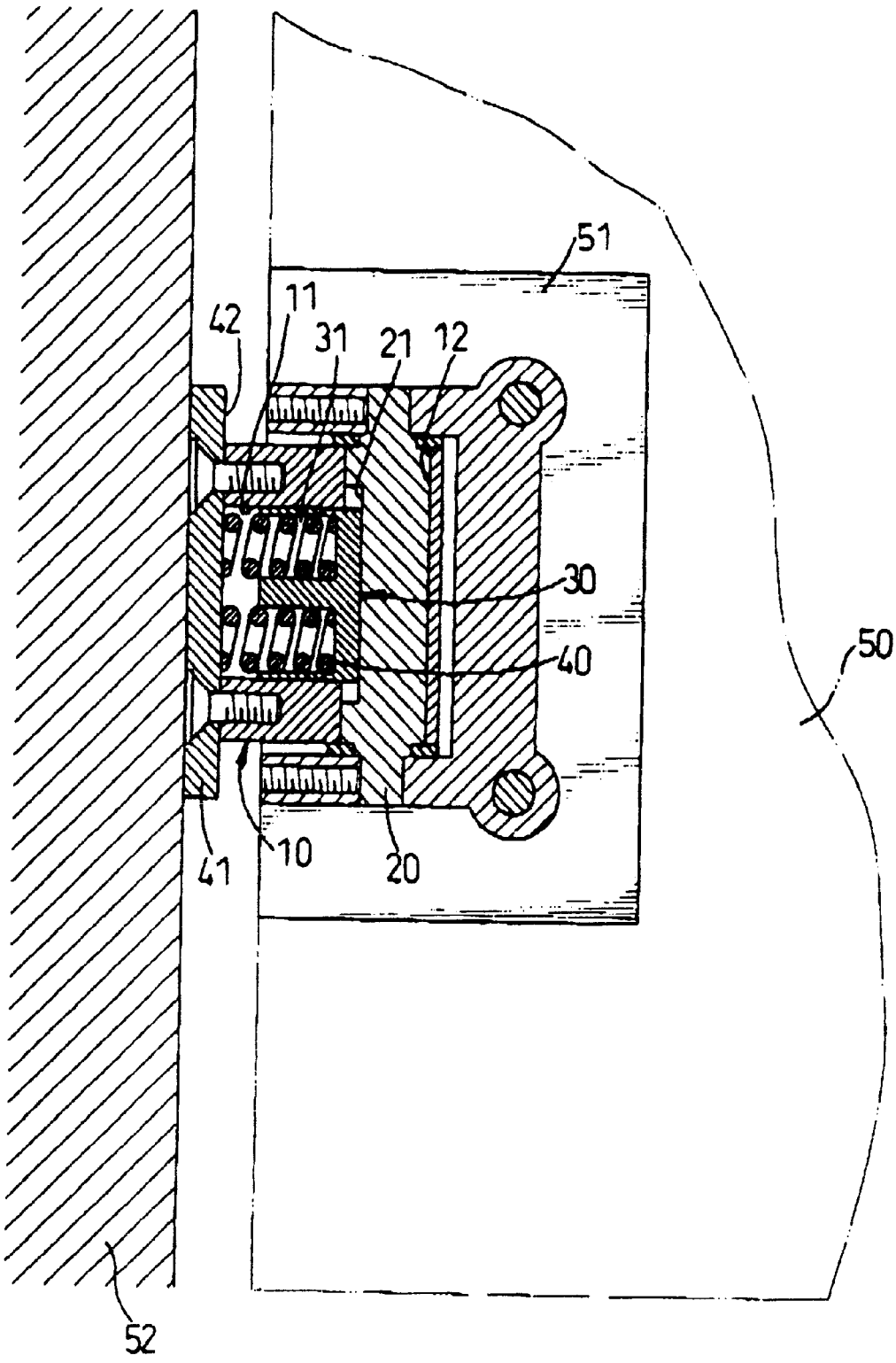
FIG. 2 is a cross sectional front plan view of the auto-return device in FIG. 1.
Figure 3:
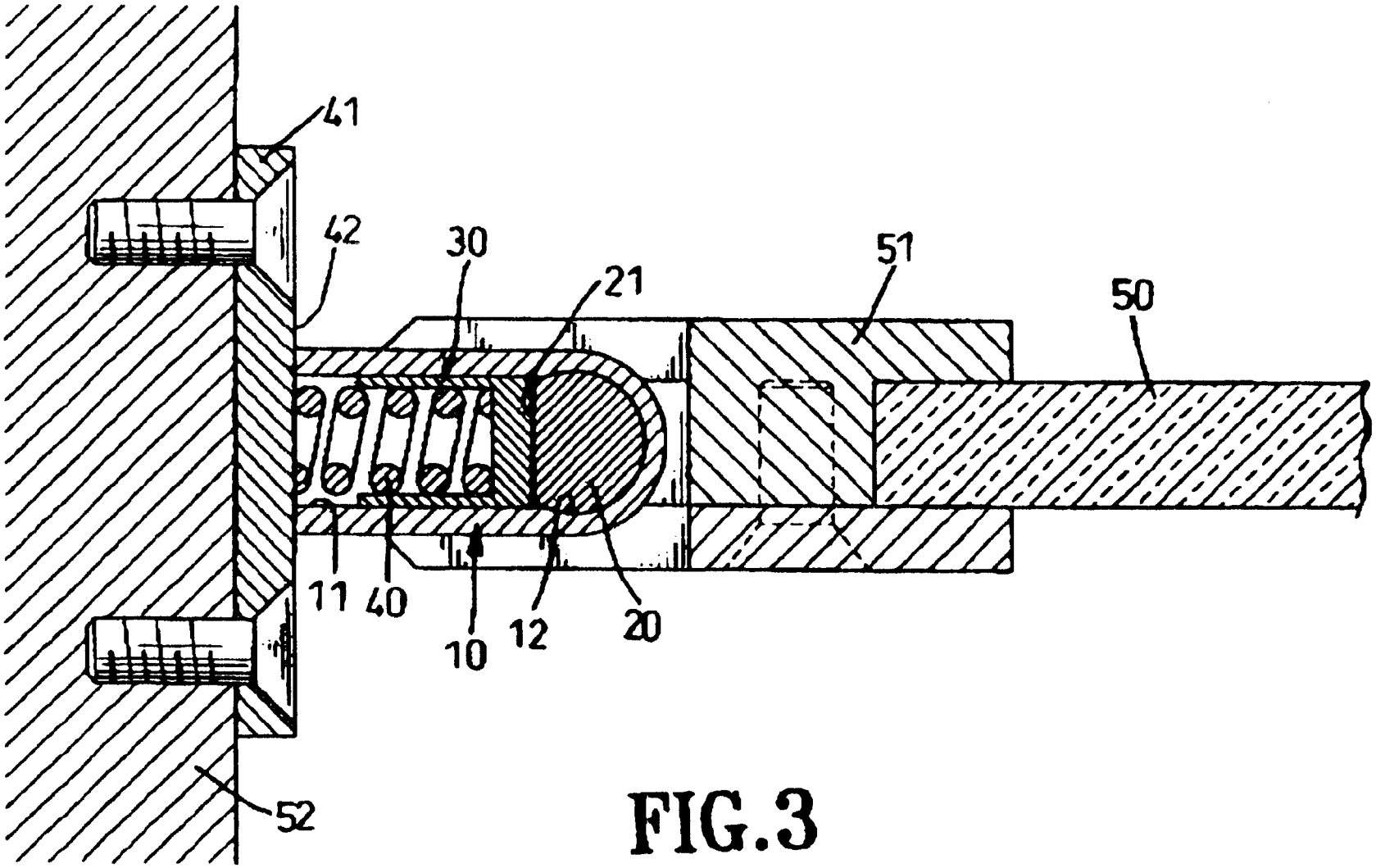
FIG. 3 is a cross sectional top plan view of the auto-return device in FIG. 1.

With reference to the drawings and initially to FIGS. 1–3, a hinge auto-return device for a glass door in accordance with the present invention comprises a body (10), a pivot pin (20), a positioning block (30) and at least one resilient member (40). The pivot pin (20) is rotatably received in the body (10). The positioning block (30) is movably received in the body (10). The resilient member(s) (40) is compressively mounted in the positioning block (30).

The body (10) comprises a pivot hole (12) and a guide hole (11). The pivot hole (12) is longitudinally defined through the body. The guide hole (11) is laterally defined in the body (10) and perpendicularly communicates with the pivot hole (12) in the body (10). The depth of the guide hole (11) is greater than a length of the positioning block (30). The pivot pin (20) is a cylinder having a round surface, and has a longitudinal flat positioning segment (21) formed on the cylindrical surface and selectively facing the guide hole (11) in the body (10) when the door is closed. The positioning block (30) has a shape corresponding to that of the guide hole (11) in the body (10). Two blind holes (31) are longitudinally defined in the positioning block (30). The central axis of each blind hole (31) is perpendicular to the axis of the pivot pin (20) and the plane of contact face abutting the flat positioning segment (21) of the pivot pin (20). The two resilient members (40) are respectively mounted in a corresponding one of the two blind holes (31) in the positioning block (30). A mounting plate (41) is adapted to be attached on a vertical casement (52). The mounting plate (41) has a contact side (not numbered) abutting the vertical casement (52) and a mounting side (42). The body (10) is adapted to be attached to the mounting side (42) of the mounting plate (41) to hold the resilient member (40) in place between the blind holes (31) in the positioning block (30) and the mounting side (42) of the mounting plate (41).

Two opposite ends of the pivot pin (20) are respectively engaged with two door mounting plates (51). A glass door (50) is securely sandwiched between the two door mounting plates (51).

With reference to FIG. 3, when the glass door (50) is in a fully closed position, the contact face of the positioning block (30) is forced by the resilience of the resilient member (40) to abut the flat positioning segment (21) of the pivot pin (20).

Figure 4:
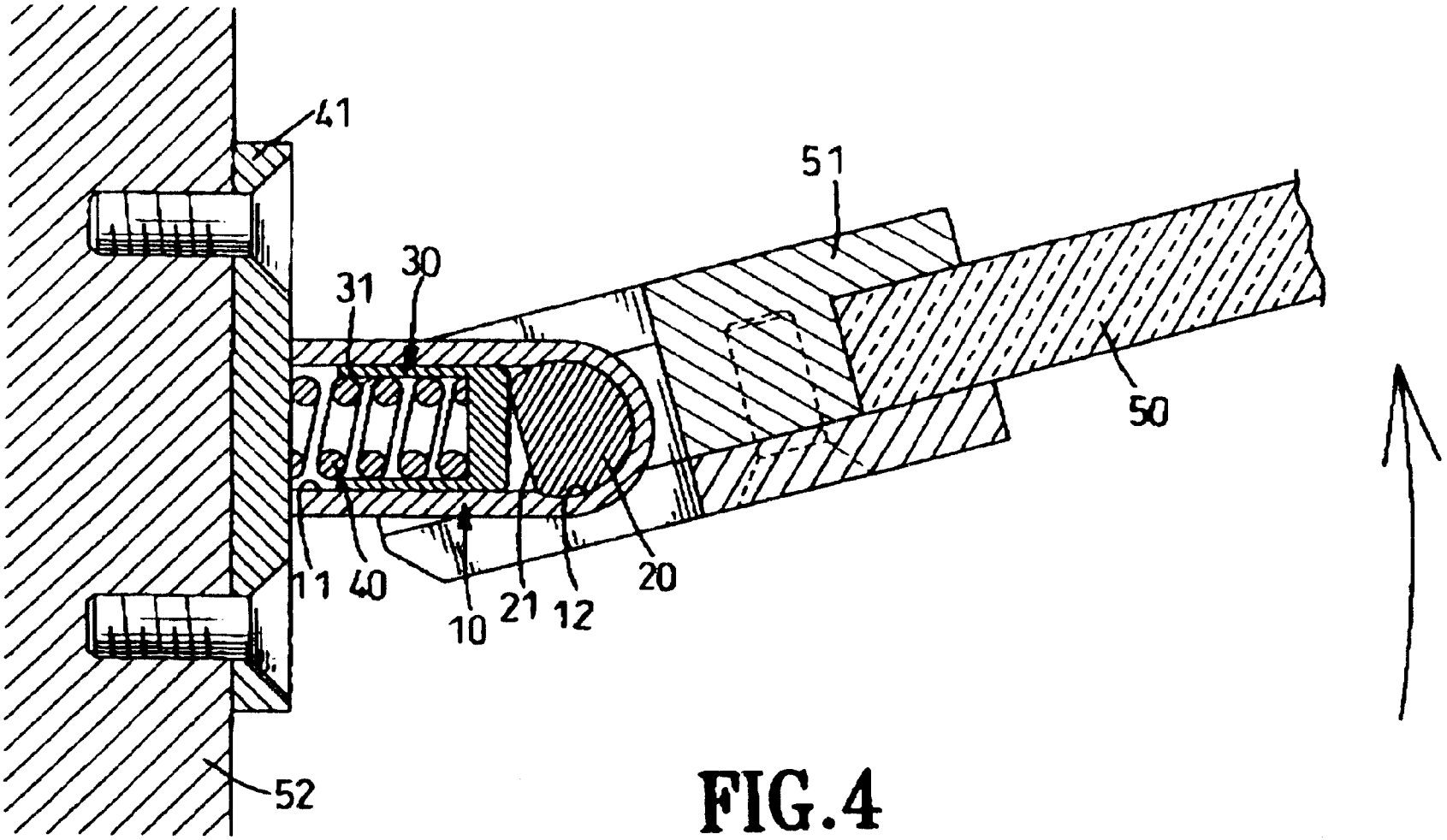
FIG. 4 is an operational cross sectional top plan view of the auto-return device in FIG. 1.

With reference to FIG. 4, when the glass door (50) is opened, the pivot pin (20) is turned around its own axis, the positioning block (30) pressed by the round surface of the pivot pin (20) moves towards the resilient members (40) and each of the resilient members (40) is compressed by the positioning block (30). When the glass door (50) is released, the positioning block (30), forced by resilience of the resilient members (40), moves towards the pivot pin (20). Because the flat positioning segment (21) of the pivot pin (20) is pressed by the contact face of the positioning block (30), the pivot pin (20) turns until the glass door (50) returns to its fully closed position. With the glass door (50) in the fully closed position, the flat positioning segment (21) abuts the contact face of the positioning block (30) and holds the glass door (50) closed.

Figure 5:
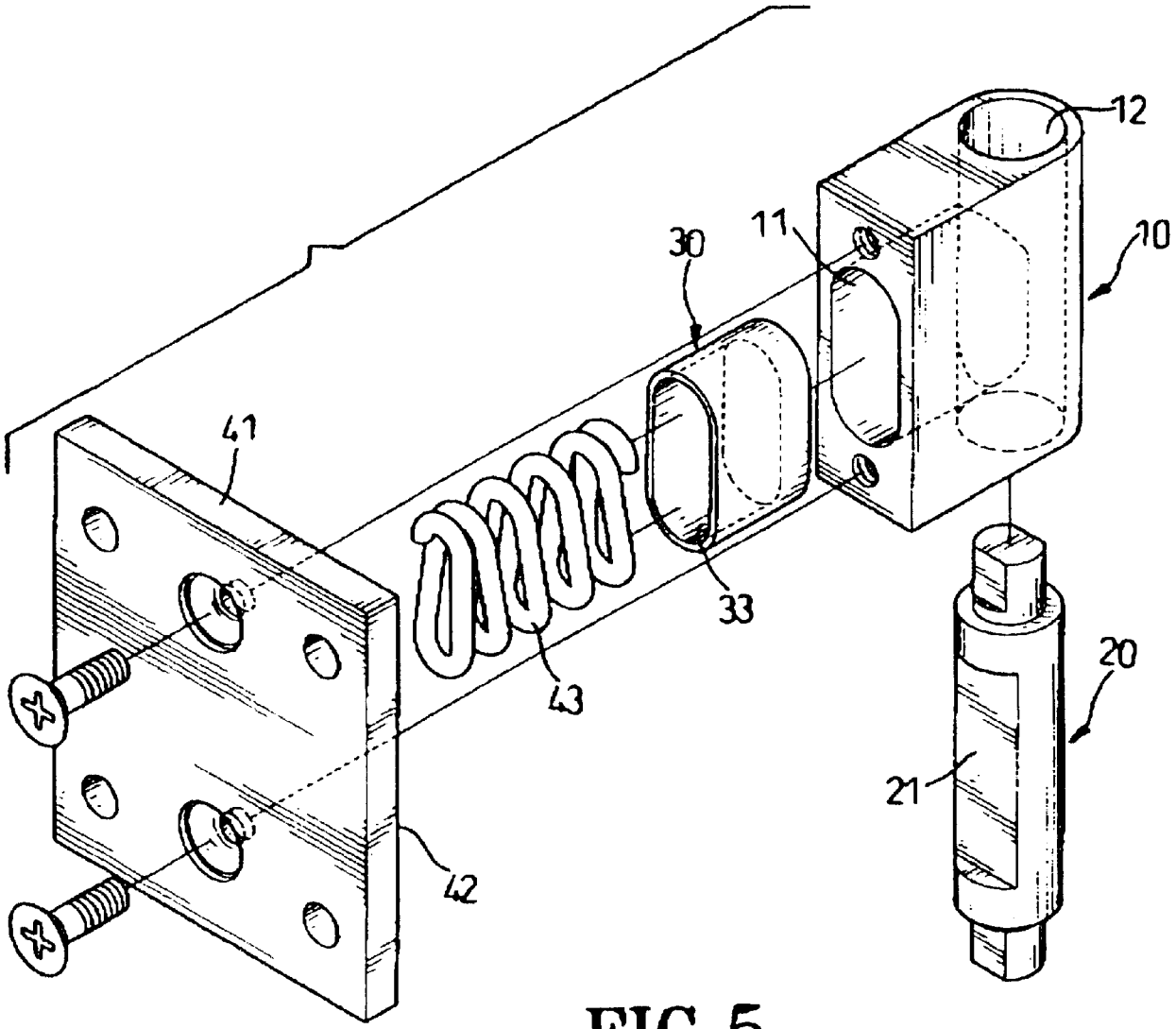
FIG. 5 is an exploded perspective view of a second embodiment of the hinge auto-return device for a glass door in accordance with the present invention.

With reference to FIG. 5, a second embodiment of the positioning block (30) of the hinge auto-return device for a glass door has a non-round cavity (33) laterally defined in the positioning block (30) and corresponding to the axis of the pivot pin (20). The cavity (33) has a shape corresponding to the shape of an outer periphery of the positioning block (30) and the resilient member (43) has a shape corresponding to that of the cavity (33) to prevent the resilient member (43) from rotating in the cavity (33). The resilient member (43) provides a suitable resilient force between the positioning block (30) and the mounting plate (41).

Figure 6:
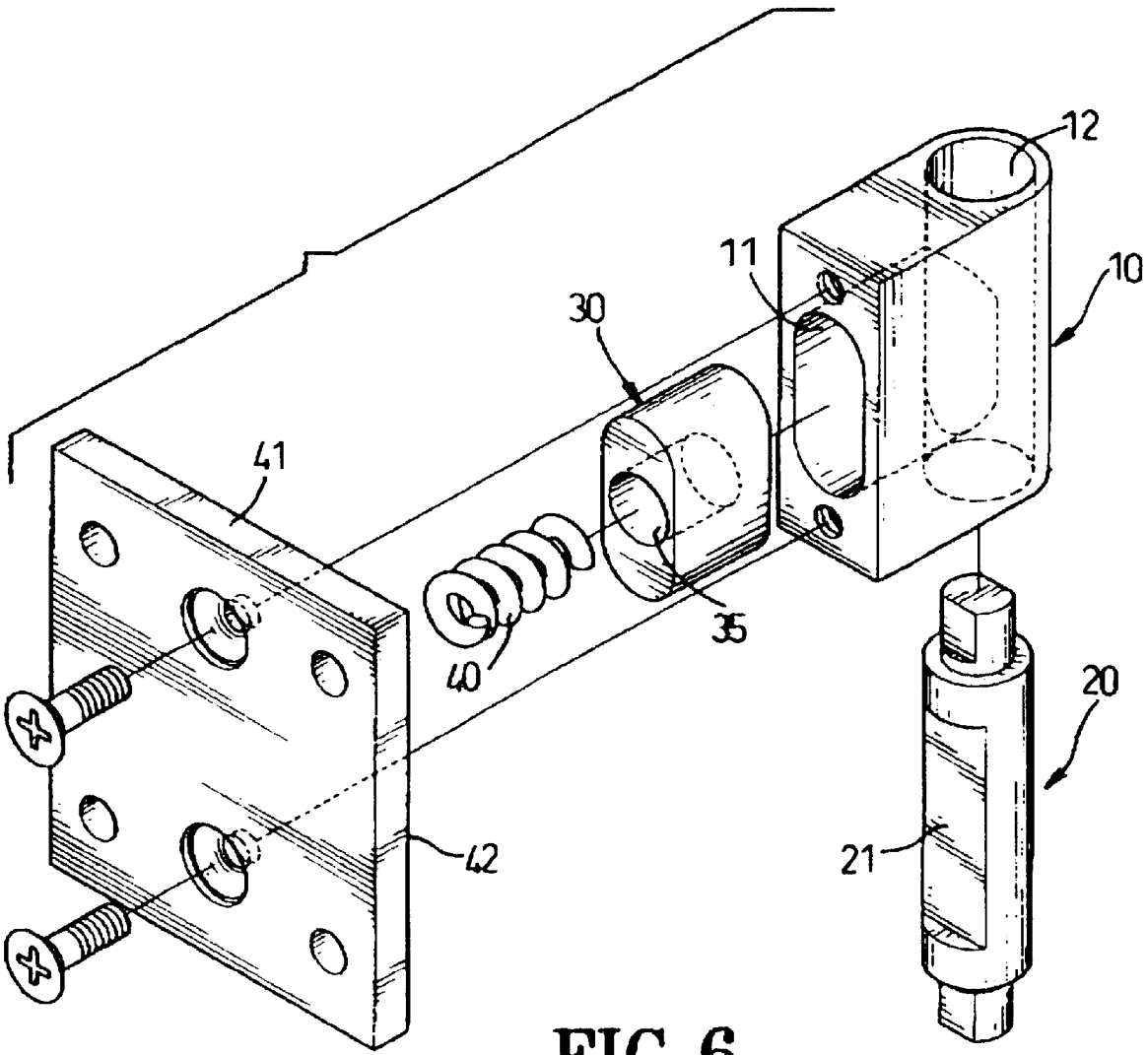
FIG. 6 is an exploded perspective view of a third embodiment of the hinge auto-return device for a glass door in accordance with the present invention.
Figure 7:
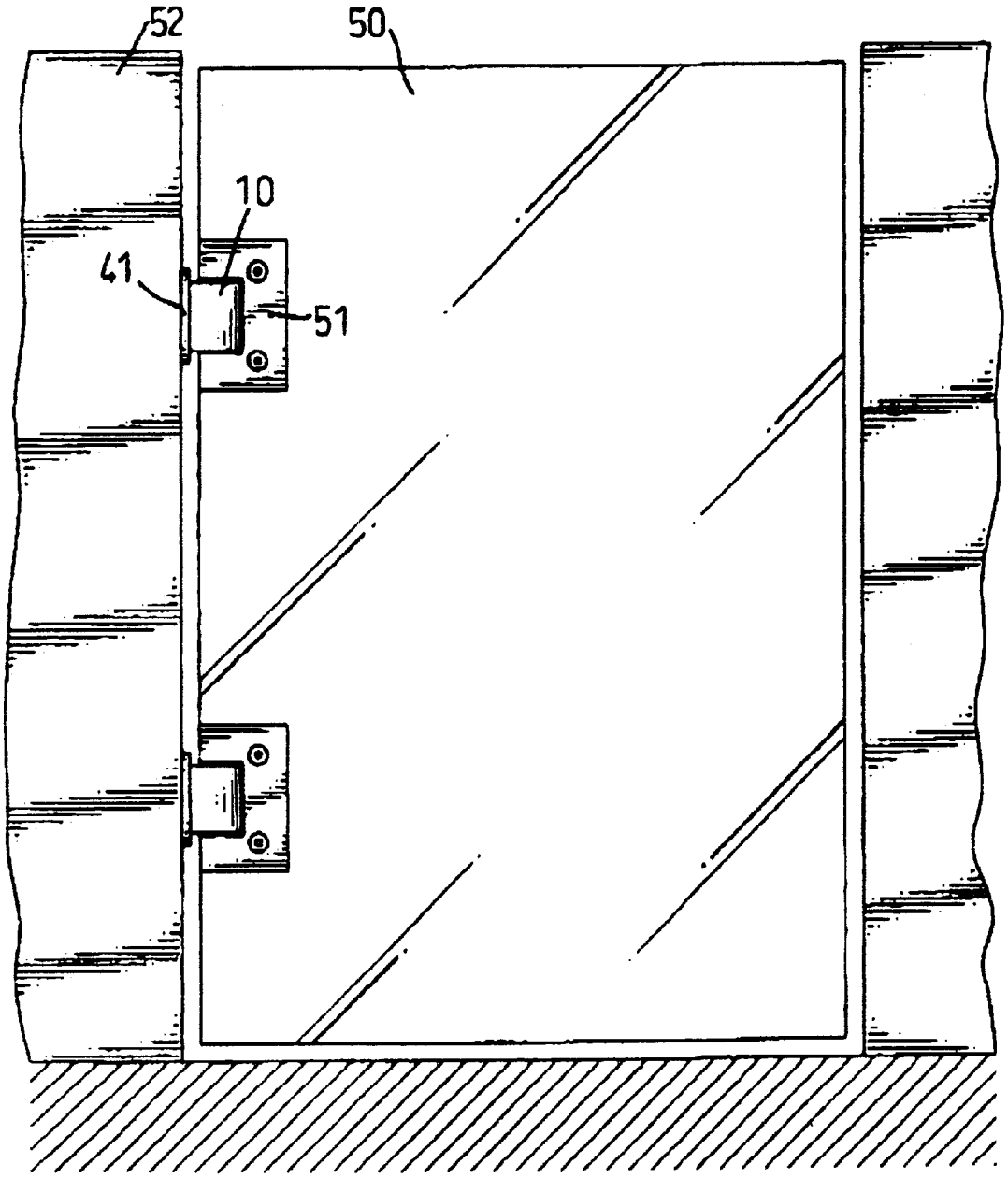
FIG. 7 is a front plan view of a glass door with the auto-return device in accordance with the present invention.
Figure 8:
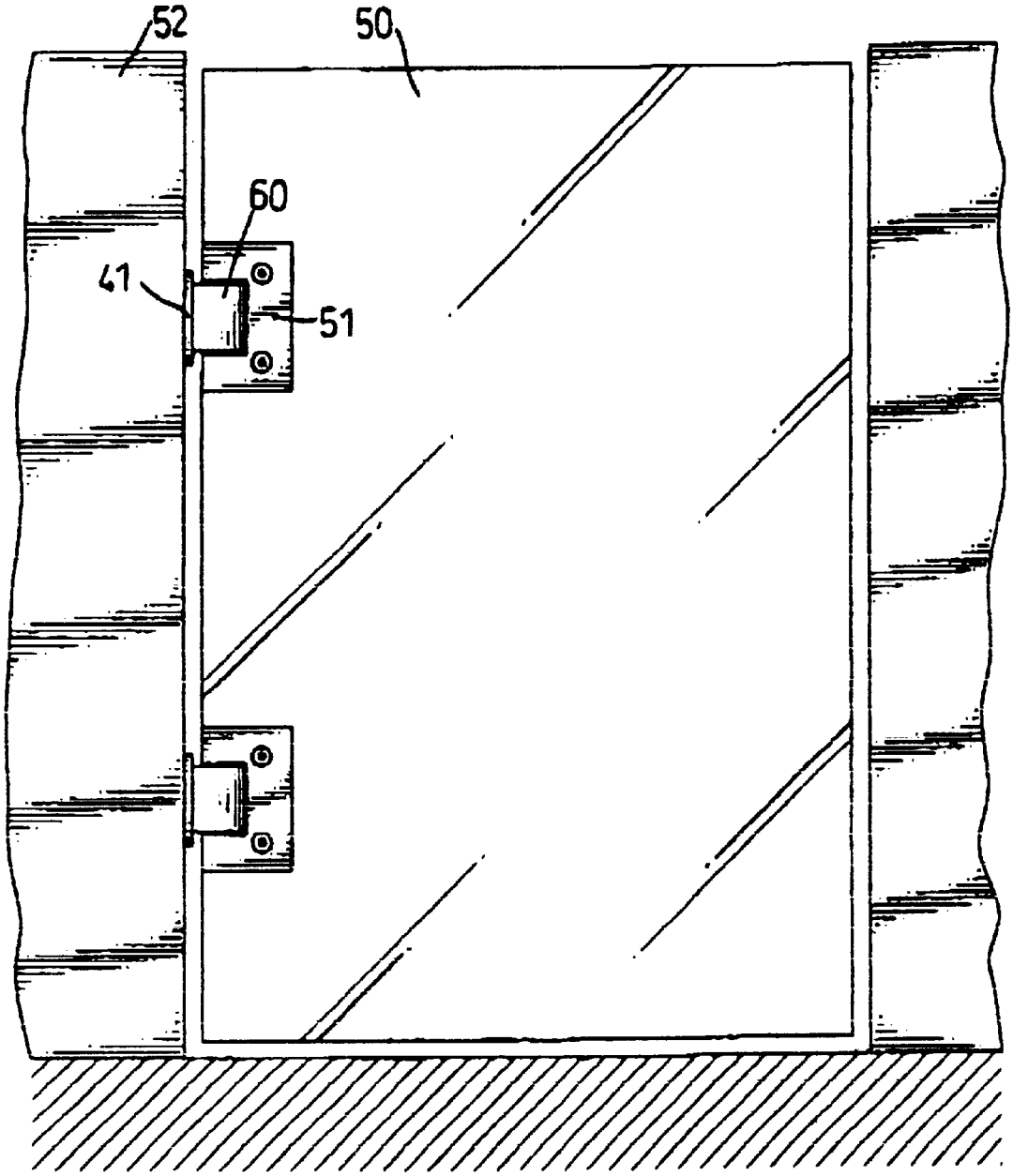
FIG.8 PRIOR ART
FIG. 8 is a front plan view of a glass door with conventional hinges.
Figure 9:
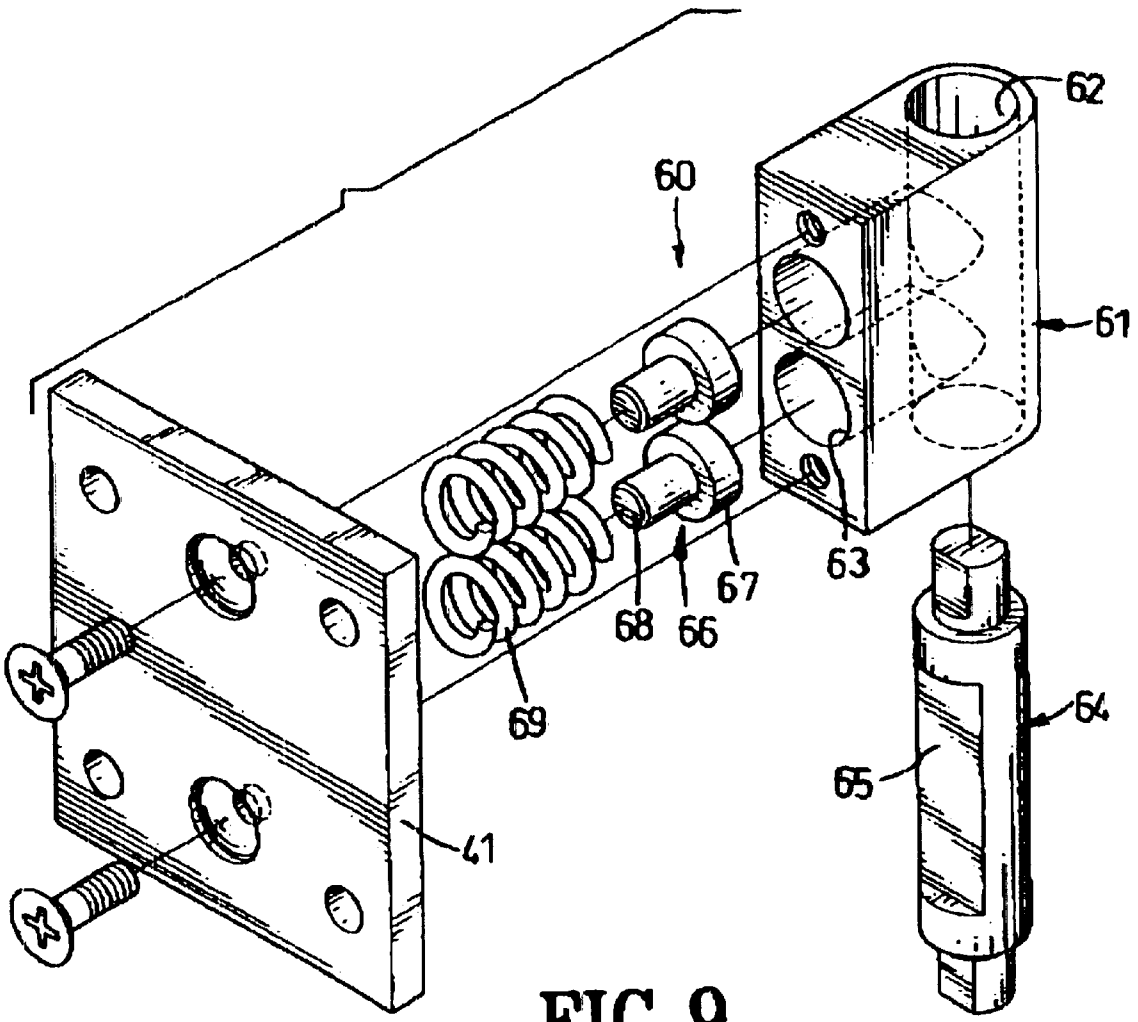
FIG. 9 PRIOR ART
FIG. 9 is an exploded perspective view of a first embodiment of a conventional hinge auto-return device.
Figure 10:
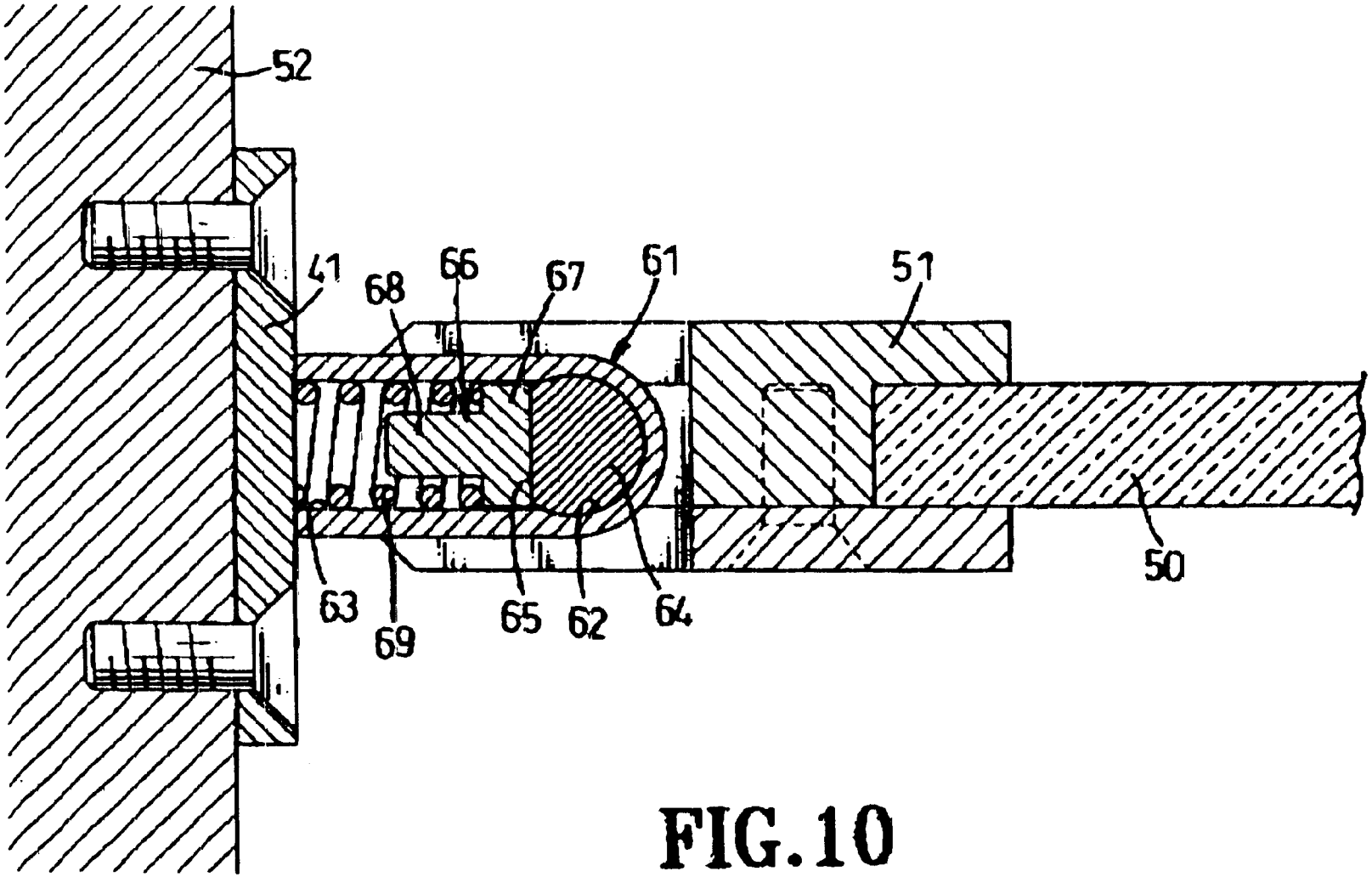
FIG. 10 PRIOR ART
FIG. 10 is a cross sectional plan top view of the hinge auto-return device in FIG. 9.
Figure 11:
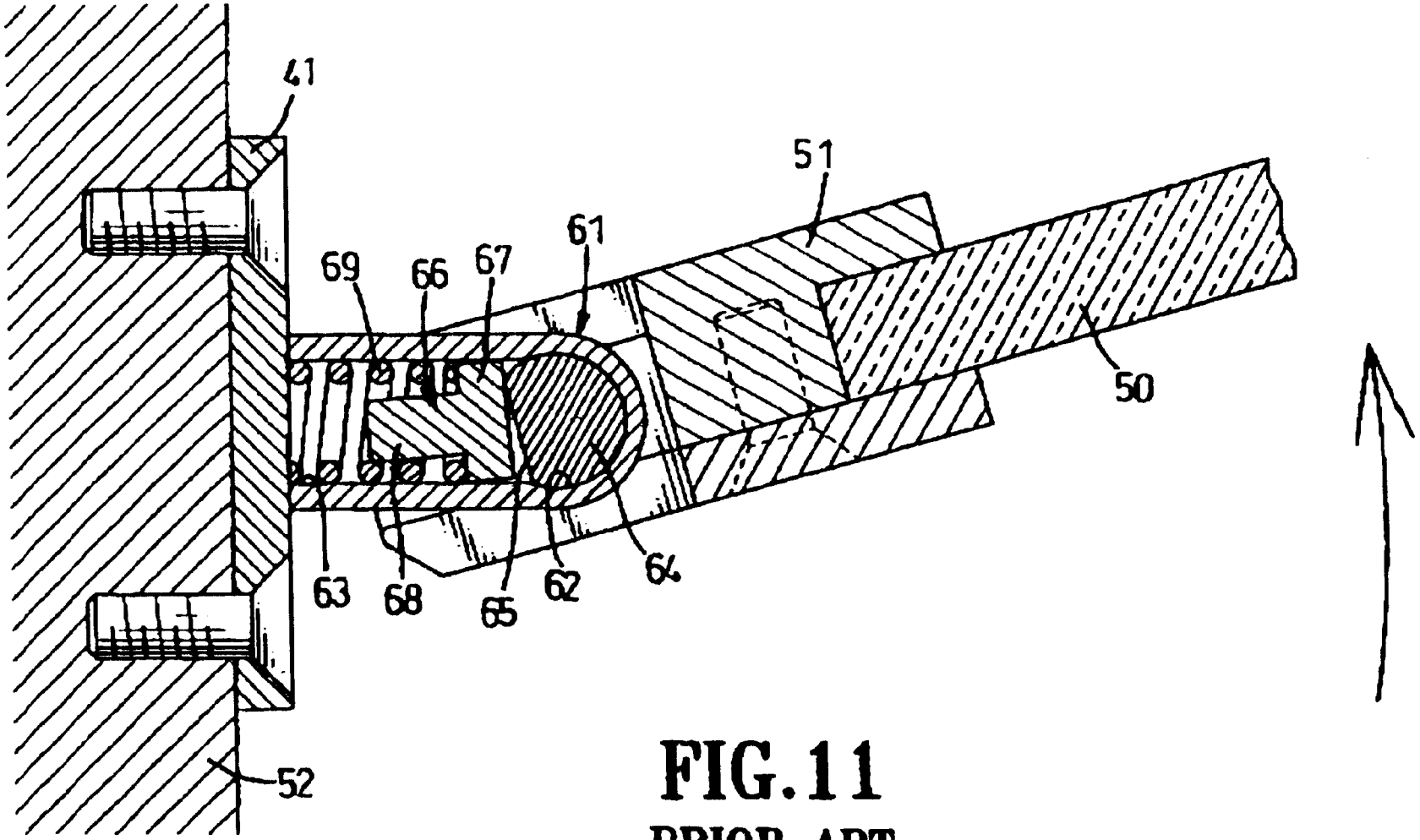
FIG. 11 PRIOR ART
FIG. 11 is an operational top plan view of the hinge auto-return device in FIG. 9.
Figure 12:
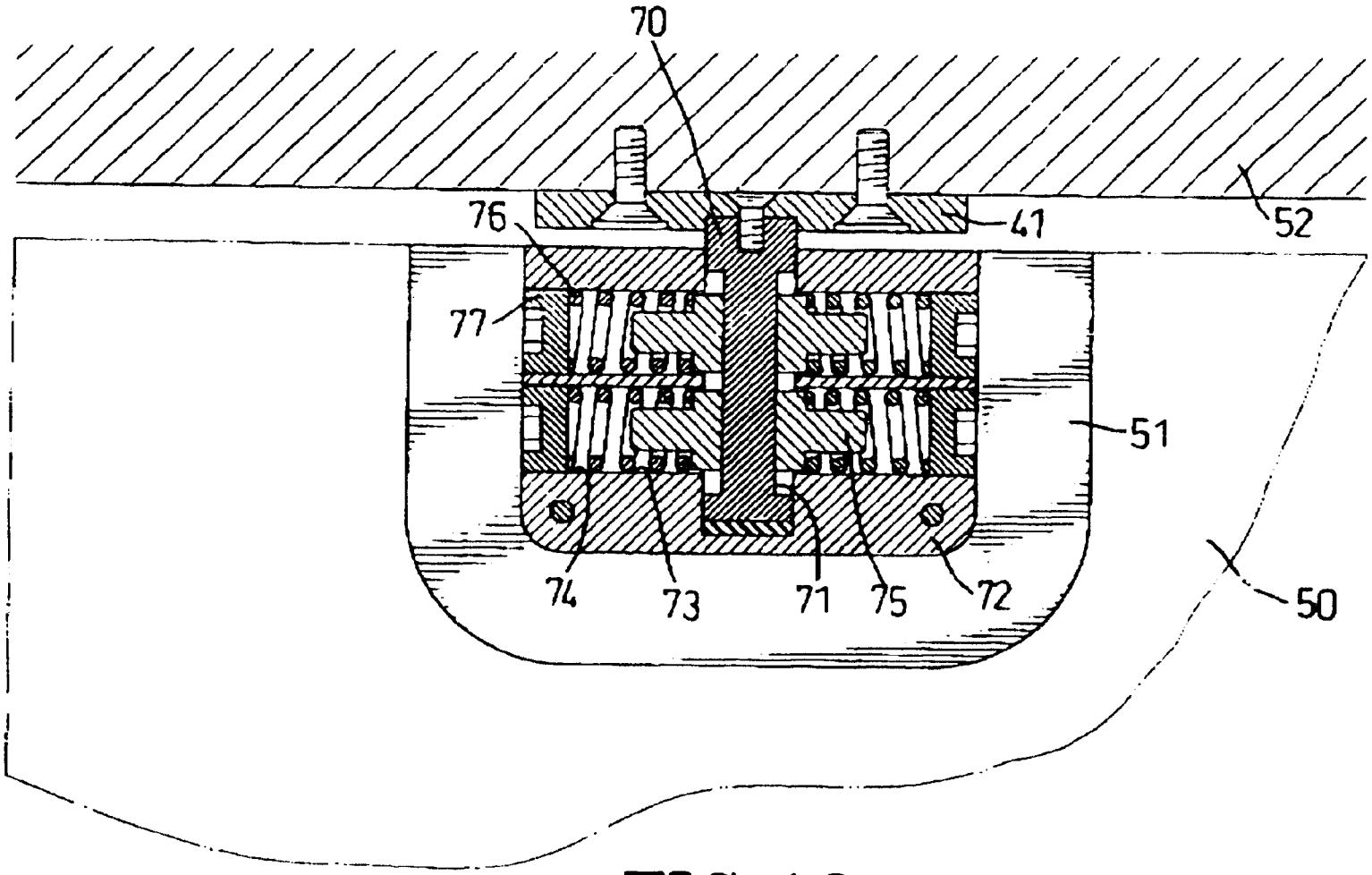
FIG. 12 PRIOR ART
FIG. 12 is a cross sectional front plan view of a second embodiment of a conventional hinge auto-return device.

With reference to FIG. 6, a third embodiment of the positioning block (30) of the hinge auto-return device for a glass door only has one blind hole (35) longitudinally and centrally defined in the positioning block (30) and corresponding to the axis of the pivot pin (20). A resilient member (40) is mounted in the blind hole (35). The resilient member (40) is compressed between the positioning block (30) and the mounting side (42) of the mounting plate (41) to provide a suitable resilience when the glass door (50) is lighter than that of the first embodiment as previously described.

With reference to FIGS. 1, 5 and 6, the resilient members of all of the embodiments of the present invention are compressible coil springs.

The auto-return device of a hinge for a glass door in accordance with the present invention has the following advantages.

1. The positioning block (30) has large surface area abutting the inner surface of the guide hole (11) in the body (10) so that the positioning block (30) is positioned stably and the auto-return device works reliably.

2. Because the positioning block (30) moves along the guide hole (11) smoothly and stably, the inner surface of the guide hole (11) is worn less so the useful life of the auto-return device is prolonged.

Although the invention has been explained in relation to its preferred embodiment, it is to be understood that many other possible modifications and variations can be made without departing from the spirit and scope of the invention as hereinafter claimed.

What is claimed is:

1. A hinge auto-return device for a glass door, the hinge auto-return device comprising:

a body including a pivot hole defined longitudinally and a guide hole defined laterally in the body, the guide hole extending perpendicular to communicate with the pivot hole;

a pivot pin rotatably received in the pivot hole in the body, the pivot pin having a round surface and a flat positioning segment formed on an outer periphery of the pivot pin and selectively facing the guide hole in the body;

a positioning block movably received in the guide hole in the body, the positioning block having a length smaller than a depth of the guide hole in the body and including:

a shape corresponding to that of the guide hole in the body;

two blind holes longitudinally defined to correspond to an axis of the pivot pin and partially receiving a respective one of the two resilient members in the positioning block; and a contact face abutting the flat positioning segment of the pivot pin;

wherein the body is adapted to be mounted on a mounting side of a mounting plate that is secured on a vertical casement so that the resilient members are held in place between the positioning block and the mounting plate and the auto-return device is attached to the vertical casement.

2. The hinge auto-return device as claimed in claim 1, wherein the positioning block comprises two non-round cavities longitudinally defined to correspond to the axis of the pivot pin, the cavities each having a shape corresponding to that of the positioning block and the resilient members each having a shape corresponding to that of the respective non-round cavity to prevent the resilient members from rotating in the respective cavity.

3. The hinge auto-return device as claimed in claim 3, wherein the resilient member is a spring.

4. The hinge auto-return device as claimed in claim 1, wherein the resilient member is a spring.

* * * * *